US010524566B2

(12) United States Patent
Brown

(10) Patent No.: US 10,524,566 B2
(45) Date of Patent: Jan. 7, 2020

(54) COLLAPSIBLE STAND FOR HOLDING AND DISPENSING CRAFT MATERIALS

(71) Applicant: Susan Brown, Southaven, MS (US)

(72) Inventor: Susan Brown, Southaven, MS (US)

( * ) Notice: Subject to any disclaimer, the term of this patent is extended or adjusted under 35 U.S.C. 154(b) by 0 days.

(21) Appl. No.: 16/280,373

(22) Filed: Feb. 20, 2019

(65) Prior Publication Data

US 2019/0254421 A1 Aug. 22, 2019

Related U.S. Application Data

(60) Provisional application No. 62/632,962, filed on Feb. 20, 2018.

(51) Int. Cl.
*A47B 43/00* (2006.01)
*B65H 75/08* (2006.01)
*A47B 81/00* (2006.01)

(52) U.S. Cl.
CPC ..... *A47B 43/00* (2013.01); *A47B 81/00* (2013.01); *B65H 75/08* (2013.01)

(58) Field of Classification Search
CPC ..... A47B 43/00; A47B 45/00; A47B 81/007; A47B 81/00; A47F 7/17; B65H 75/08
USPC ..... 211/85.5, 195; 206/391, 394, 389; 108/162; 312/258; 83/485
See application file for complete search history.

(56) References Cited

U.S. PATENT DOCUMENTS 201,328 A * 3/1878 Chamberlin ..... A63B 5/02 482/17
405,264 A * 6/1889 Lindsay ..... B42F 15/0064 402/4
529,439 A * 11/1894 Bent ..... A47F 7/08 211/38
906,347 A * 12/1908 Willner ..... B65H 23/08 242/422.5
1,554,049 A * 9/1925 Thompson ..... D06B 23/00 211/85.5
1,941,428 A * 12/1933 Beardsley ..... D06C 7/00 242/129.6
D136,476 S * 10/1943 Tucker ..... D6/682.2
2,679,321 A * 5/1954 Koeferl ..... B65B 27/083 211/50
2,940,683 A * 6/1960 Tauber ..... D05C 1/065 242/127
3,143,023 A * 8/1964 Addin ..... B26D 1/205 83/472
3,296,911 A * 1/1967 McLane ..... B26D 1/151 83/408
3,821,915 A * 7/1974 Larrable ..... B26D 1/185 83/174
4,351,208 A * 9/1982 Cobleigh ..... B26D 1/035 156/767

(Continued)

*Primary Examiner* — Jonathan Liu
*Assistant Examiner* — Devin K Barnett
(74) *Attorney, Agent, or Firm* — Dunlap Bennett & Ludwig PLLC

(57) ABSTRACT

A collapsible stand for holding and dispensing craft materials includes a base having a front, a rear, a first side, a second side, an upper surface, and a lower surface. A first arm is coupled to the upper surface at the first side of the base by a first hinge. At least one first dowel slot is defined through the first arm. A second arm is coupled to the upper surface at the second side of the base by a second hinge. At least one second dowel slot is defined through the second arm.

7 Claims, 4 Drawing Sheets

(56) References Cited

U.S. PATENT DOCUMENTS 4,978,014 A * 12/1990 Humitz ..... B65D 19/12 108/54.1
5,103,710 A * 4/1992 Ross ..... B26D 1/045 83/485
5,139,160 A * 8/1992 Romano ..... B44C 7/02 211/44
5,242,255 A * 9/1993 Gleffe ..... B65D 19/12 414/403
5,527,242 A * 6/1996 Gangloff ..... A63B 1/005 482/104
5,692,625 A * 12/1997 Filipescu ..... A47B 43/00 211/194
5,894,978 A * 4/1999 Welch ..... B26D 1/035 225/18
5,938,145 A * 8/1999 Dueck ..... B65H 49/325 211/1.56
6,279,763 B1 * 8/2001 Bush ..... A47B 43/00 108/55.1
6,523,776 B1 * 2/2003 Elder ..... B65H 49/32 211/85.5
6,595,462 B2 * 7/2003 Lenski ..... B65H 49/32 242/157 R
6,991,118 B2 * 1/2006 Phillips ..... A45C 11/16 211/49.1
7,098,406 B1 * 8/2006 Hammonds ..... B65H 75/06 174/135
D532,994 S * 12/2006 Rice ..... D6/682.6
7,726,222 B2 * 6/2010 Endresen ..... B26D 1/025 83/408
7,866,241 B2 * 1/2011 Yu Chen ..... B26D 1/065 83/454
8,065,944 B1 11/2011 Speas, Jr.
8,172,099 B1 * 5/2012 Hardy ..... A23G 3/10 211/13.1
8,342,544 B1 * 1/2013 Blewett ..... B62B 3/022 211/189
8,763,505 B2 * 7/2014 Ishihara ..... B26D 1/185 83/455
8,801,419 B1 * 8/2014 Oskirka ..... A21C 15/00 211/123
8,833,711 B2 * 9/2014 Fritz ..... A47B 95/00 211/175
8,936,166 B2 * 1/2015 Hornsby ..... A47G 25/0685 211/182
8,955,700 B2 * 2/2015 Barber ..... A47F 7/04 211/195
9,815,657 B1 * 11/2017 Livingston ..... B65H 49/321
2005/0000340 A1 * 1/2005 Petersen ..... B26D 1/025 83/485
2005/0103730 A1 * 5/2005 Hosilyk ..... A47F 7/17 211/85.5
2005/0120850 A1 * 6/2005 Loibl ..... B26D 1/185 83/485
2006/0091096 A1 * 5/2006 Velez ..... B62B 3/002 211/194
2007/0125214 A1 * 6/2007 Dong et al. ..... B26D 1/205 83/485
2007/0131634 A1 * 6/2007 Markle ..... A47G 1/12 211/189
2007/0169602 A1 * 7/2007 Peterson ..... B26D 1/045 83/485
2008/0034936 A1 * 2/2008 Loibl ..... B26D 7/025 83/455
2008/0217276 A1 * 9/2008 Brady ..... B65D 19/12 211/195
2008/0237168 A1 * 10/2008 Harpole ..... B65D 19/12 211/195
2009/0065457 A1 * 3/2009 Kostigian ..... A47F 7/175 211/85.5
2009/0159475 A1 * 6/2009 Limber ..... A47F 7/0028 206/391
2011/0174754 A1 * 7/2011 Entz ..... A47B 43/00 211/202
2011/0180505 A1 * 7/2011 Noniewicz ..... B27B 17/0041 211/195
2011/0226888 A1 * 9/2011 Jacquart ..... A47F 7/17 242/564.5
2014/0014607 A1 * 1/2014 Mikich ..... A47B 43/00 211/195
2014/0339183 A1 * 11/2014 Cash ..... A47B 81/007 211/85.5
2016/0007744 A1 * 1/2016 Fasino ..... A47F 3/06 312/330.1

* cited by examiner

COLLAPSIBLE STAND FOR HOLDING AND DISPENSING CRAFT MATERIALS

CROSS-REFERENCE TO RELATED APPLICATION

This application claims the benefit of priority of U.S. provisional application No. 62/632,962, filed Feb. 20, 2018, the contents of which are herein incorporated by reference.

BACKGROUND OF THE INVENTION

The present invention relates to home crafting and, more particularly, to a collapsible stand for holding and dispensing craft materials.

Crafting with decorative mesh, ribbons and other materials that are dispensed on a spool can be difficult to manage. This is due to the products curling and rolling away from one while attempting to measure and cut materials. Crafting with spooled materials that roll can be frustrating and contribute to a messy unorganized work space.

Current products on the market that dispense spooled materials are for industrial use. These devices are too large and insufficient for home crafting use. They also do not dispense multiple rows of materials at once, nor do any of the current products collapse.

As can be seen, there is a need for a collapsible stand for holding and dispensing craft materials.

SUMMARY OF THE INVENTION

In one aspect of the present invention, a collapsible stand for holding and dispensing craft materials comprises: a base comprising a front, a rear, a first side, a second side, an upper surface, and a lower surface; a first arm coupled to the upper surface at the first side by a first hinge, wherein at least one first dowel slot is defined through the first arm; and a second arm coupled to the upper surface at the second side by a second hinge, wherein at least one second dowel slot is defined through the second arm, wherein the collapsible stand comprises an expanded configuration and a collapsed configuration, the expanded configuration comprising the first arm and the second arm pivoted upward from the base in a vertical position so that the least one first dowel slot aligns with the least one second dowel slot, and the collapsed configuration comprises the first arm and the second arm pivoted downward towards the base in a horizontal position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a collapsible stand for holding and dispensing crafting materials, such as deco mesh, ribbons, and the like. This collapsible mesh roller, holder, and stand easily holds multiple rolls of crafting materials and neatly dispenses materials without curling to make cutting and measuring easier. The present invention further collapses for easy storage when not in use. The collapsible stand provides easy access and organization of crafting materials.

Figure 1:
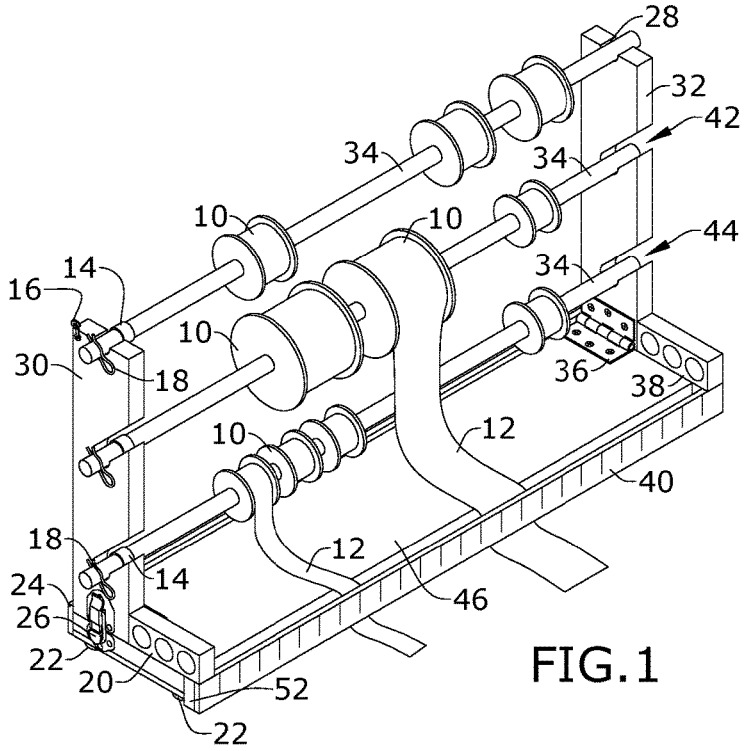
FIG. 1 is a perspective view of an embodiment of the present invention in use.
Figure 2:
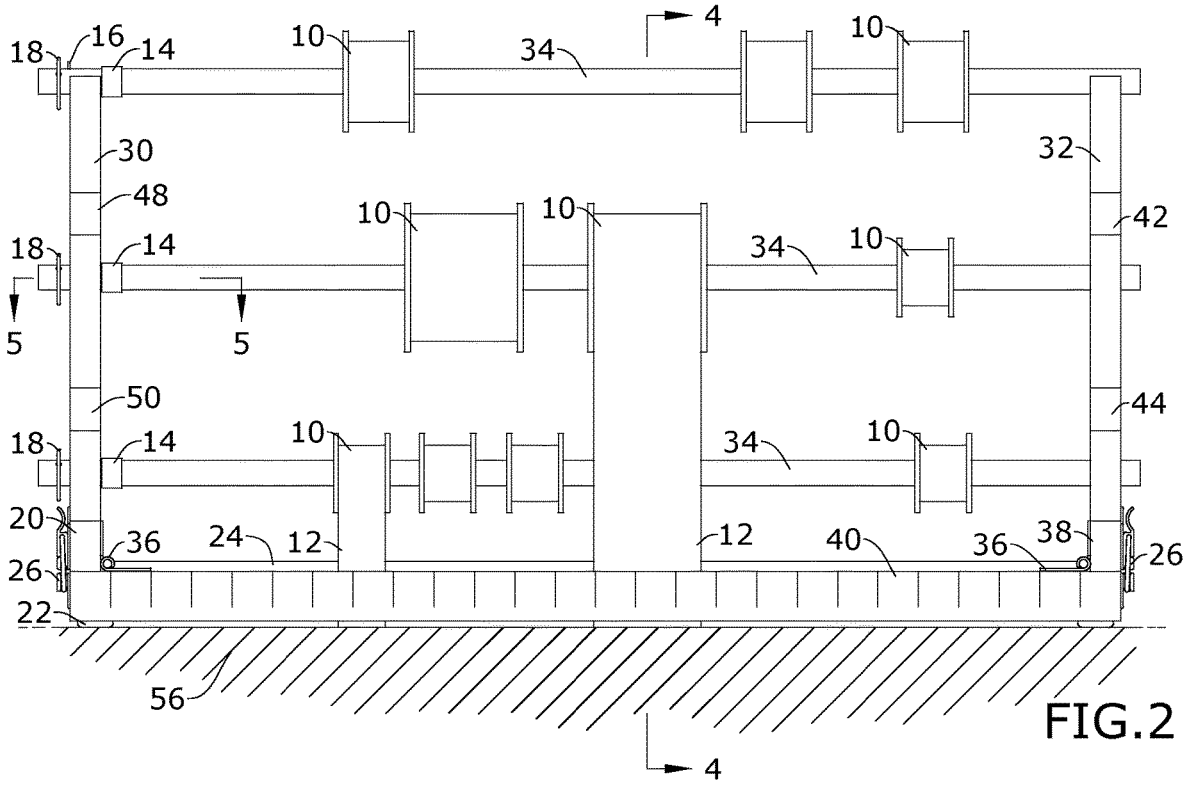
FIG. 2 is a front view of an embodiment of the present invention in use.
Figure 3:
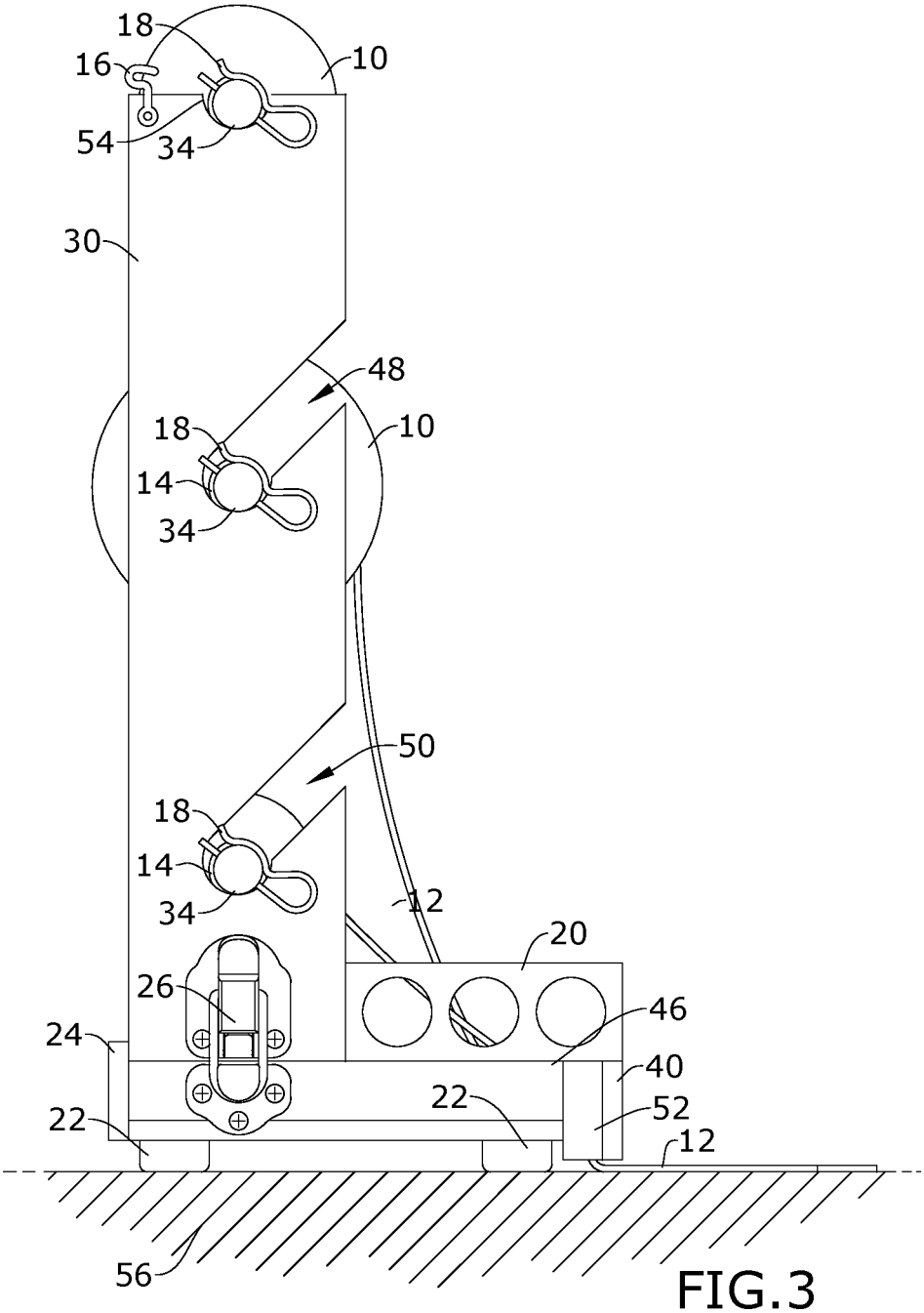
FIG. 3 is a side view of an embodiment of the present invention in use.
Figure 4:
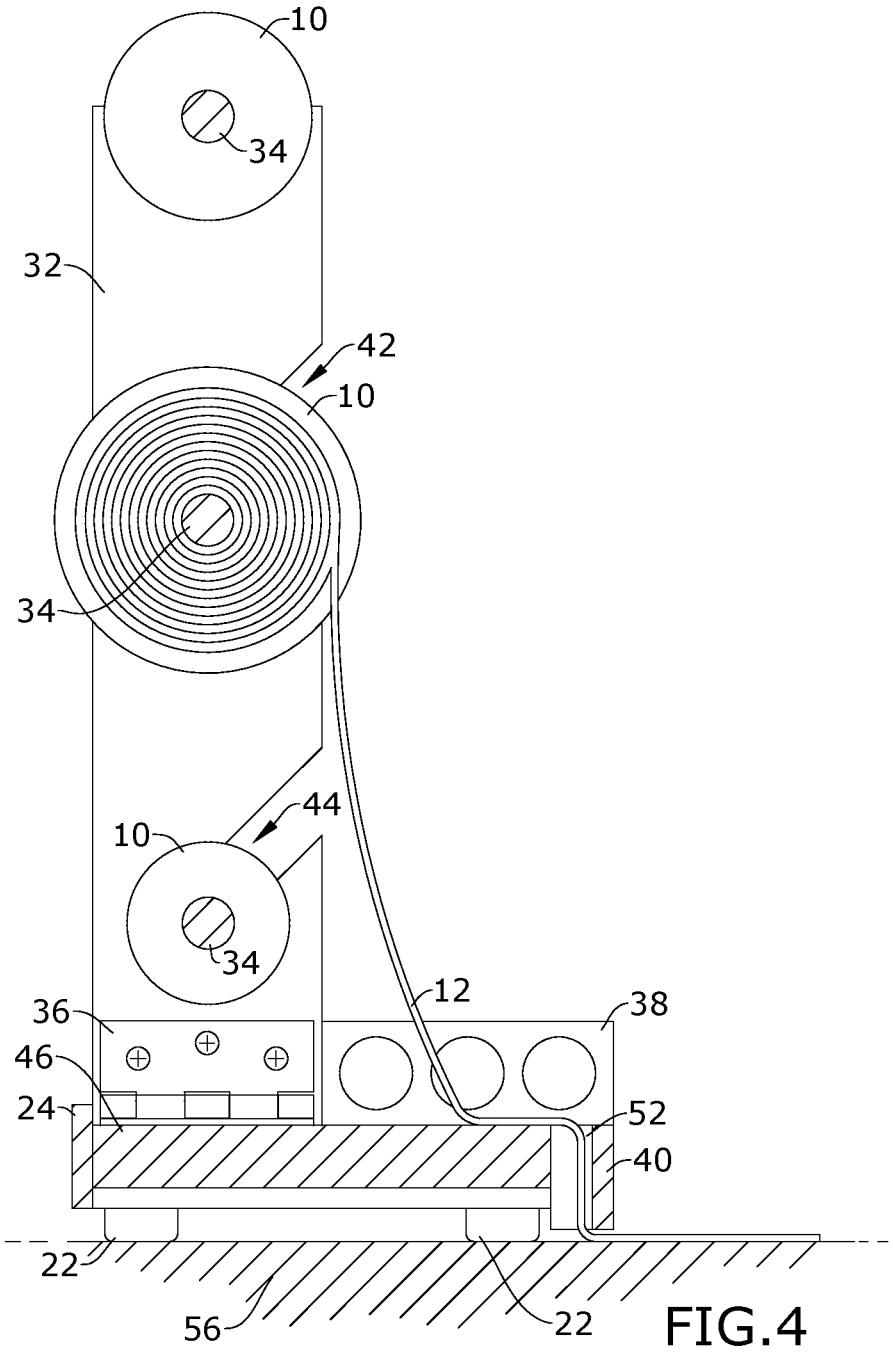
FIG. 4 is a section view of the present invention taken along line 4-4 in FIG. 2.
Figure 5:
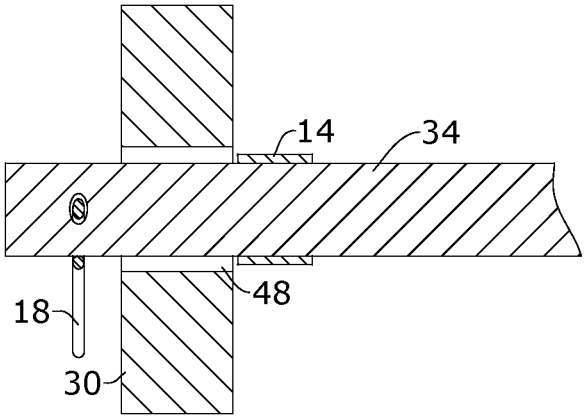
FIG. 5 is a section view of the present invention taken along line 5-5 in FIG. 2.
Figure 6:
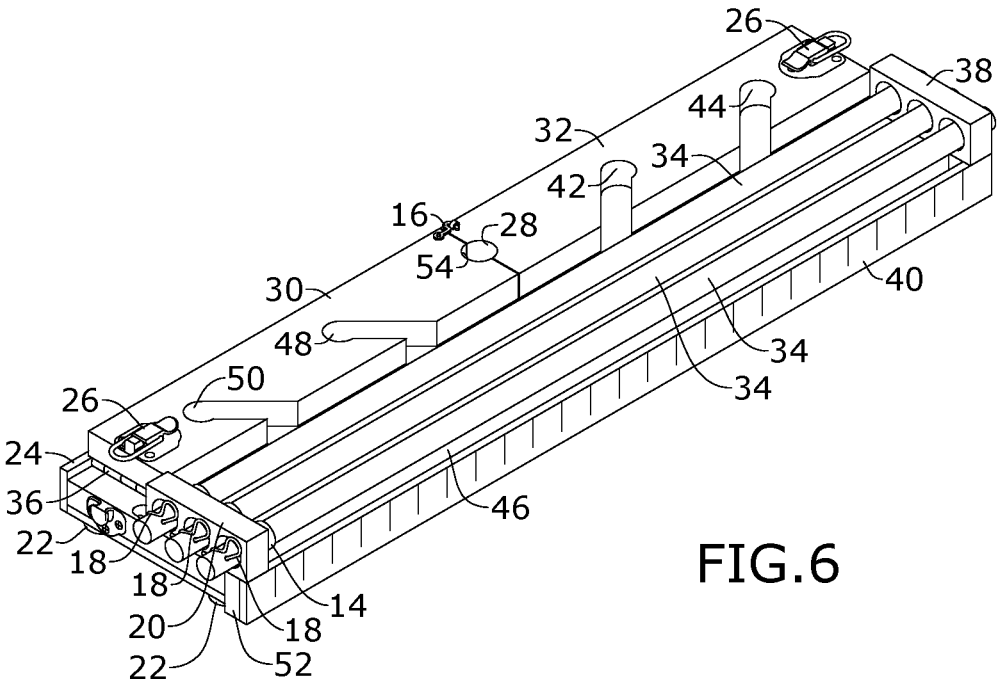
FIG. 6 is a perspective view of an embodiment of the present invention in a collapsed configuration.

Referring to FIGS. 1 through 6, the present invention includes a collapsible stand for holding and dispensing craft materials. The stand includes a base 46 having a front, a rear, a first side, a second side, an upper surface, and a lower surface. A first arm 30 is coupled to the upper surface at the first side of the base 46 by a first hinge 36. At least one first dowel slot 48, 50, 54 is defined through the first arm 30. A second arm 32 is coupled to the upper surface at the second side of the base 46 by a second hinge 36. At least one second dowel slot 28, 42, 44 is defined through the second arm 32.

The collapsible stand includes an expanded configuration and a collapsed configuration. The expanded configuration includes the first arm 30 and the second arm 32 pivoted upward from the base 46 in a vertical position so that the first dowel slot 48, 50, 54 aligns with the second dowel slot 28, 42, 44, and the collapsed configuration includes the first arm 30 and the second arm 32 pivoted downward towards the base 46 in a horizontal position.

In certain embodiments, the present invention includes a first lock 26 configured to releasably lock the first arm 30 in the expanded configuration and a second lock 26 configured to releasably lock the second arm in the expanded configuration. The first lock 26 and the second lock 26 may be any type of lock that releasably holds the first arm 30 and the second arm 32 in a vertical position relative to the base 46. For example, the first lock 26 and the second lock 26 may each include draw catches coupled to the first side and the second side of the base 46 and the outer edge of the first arm 30 and the second arm 30.

The present invention may further include a collapse lock 16 configured to lock the first arm 30 to the second arm 32 in the collapsed configuration. The collapse lock 16 may be any type of lock that releasably holds the first arm 30 and the second arm 32 in a horizontal position relative to the base 46. For example, the collapse lock 16 may include a hook coupled to a top end of the first arm 30 and a loop coupled to the top end of the second arm 32. When the first arm 30 and the second arm 32 are pivoted towards one another in the collapsed configuration, the hook may rotate into the loop, locking the first arm 30 and the second arm 30 together.

In certain embodiments, the at least one first dowel slot 48, 50, 54 includes a first top slot 54 defined on an upper edge of the first arm 30, a first bottom slot 50, and a first middle slot 48 defined in between the first top slot 54 and the first bottom slot 50. The at least one second dowel slot 28, 42, 44 includes a second top slot 28 defined on an upper edge of the second arm 32, a second bottom slot 44, and a second middle slot 42 defined in between the second top slot 28 and the second bottom slot 44. The first top slot 54 and the second top slot 28 align in the expanded configuration, the first bottom slot 50 and the second bottom slot 44 align in the expanded configuration, and the first middle slot 48 and the second middle slot 42 align in the expanded configuration.

The first middle slot 48 and the first bottom slot 50 may each be defined starting from an outer edge of the first arm 30 and angle downwards towards a longitudinal axis of the first arm 30. An opening may be defined as an entrance into the first middle slot 48 and the first bottom slot 50 at the outer edge of the first arm 30. Further, the second middle slot 42 and the second bottom slot 44 are each defined starting from an outer edge of the second arm 32 and angle downwards towards a longitudinal axis of the second arm 32. An opening may be defined as an entrance into the second middle slot 42 and the second bottom slot 44 at the outer edge of the second arm 32.

The present invention may further include at least one dowel 34. The dowel 34 is an elongated cylindrical rod to hold rolls 10 of craft material 12, such as ribbon or mesh material. The dowel 34 fits within the at least one first dowel slot 48, 50, 54 and the at least one second dowel slot 28, 42, 44 in the expanded configuration. In certain embodiments, the present invention may include three or more dowels 34. In such embodiments, each of the dowels 34 fits within a different pair of the aligned dowel slots 48, 50, 54, 28, 42, 44 of the first arm 30 and the second arm 32 in the expanded configuration.

The present invention may further include dowel locks 14, 18 configured to releasably retain the dowels 34 within the first dowel slots 48, 50, 54, and the second dowel slot 28, 42, 44. The dowel locks 14, 18 may include any type of lock that releasably retains the dowels within the first dowel slots 48, 50, 54, and the second dowel slot 28, 42, 44 in the expanded configuration. For example, the dowel locks 14, 18 may be include a ring disposed around the respective dowel 34 having a larger circumference than the dowel slots 48, 50, 54, 28, 42, 44, and a cotter pin 18 disposed through an opening of the respective dowel 34.

The present invention may further include a first dowel holder 20 coupled to the upper surface at the front and first side of the base 46 with at least a first dowel holder opening, and a second dowel holder 38 coupled to the upper surface at the front and second side of the base 46 with at least one second dowel holder opening. In certain embodiments, each of the first dowel holder 20 and the second dowel holder 38 may include two, three or more openings. Each of the openings of the first dowel holder 20 align with the openings of the second dowel holder 38. Dowels 34 fit within the aligned dowel holder openings of the first and second dowel holders 20, 38 in the collapsed configuration.

The present invention may further include a backing 24 coupled to the rear of the base 46 and a ruler 40 coupled to the front of the base 46. The ruler 40 may be coupled to the front of the base 46 by spacers 52 so that a gap is defined between the ruler 40 and the base 46. A plurality of rubber feet 22 may be coupled to the lower surface of the base 46, thereby elevating the lower surface of the base 46 above a surface 56 in which the feet 22 are resting. This allows the material 12 supported by the dowels 34 to be rolled off of the rolls 10, run through the gap, and under the ruler 40 to be measured and cut. The gap between the ruler 40 and the base 46 holds the materials close to the work surface 56 preventing materials from curling for easy cutting and measuring.

The collapsible stand for holding and dispensing craft materials is designed to help crafters that work with spooled materials such as deco mesh, ribbons, stabilizers, fabrics, craft paper, and the like. The crafter places rods 10 of material 12 onto the dowels 34. The material 12 is then guided down into the gap between the base 46 and ruler 40 and is then pulled out along the work surface 56. The ruler 40 guides the material close to the surface 56. The multiple dowels 34 and levels provide ample space for working with multiple materials 12 at once. This can save a lot of time for the crafter as well as prevent frustration of working with materials 12 that curl up while working with them. The non-slip feet 22 keep the stand secure while working. The present invention conveniently collapses and folds away for easy storage and allows for portability while traveling to crafting events.

A method of making the present invention may include the following. Cut the wood base to spec and sand. Front facing top of base is rounded smooth. A peg hole is drilled in base on front facing left side. The front facing ruler is cut. The back side bottom corner of the ruler is rounded. The ruler is nailed and glued to front of base with printed side out, using the wooden spacers between ruler and the base. The side arms are cut and sanded. The edges of the side arms are slightly rounded. The dowel holes in the side arms are measured, drilled and sanded. The side arms are attached to each end of the base using the hinges. Hinges are offset from the end of base to allow side arms to stand in a straight upright position flush with the base. The hinges are screwed to the base and side arm. The ruler is mounted to the back of the base to provide a finished cohesive look. The back ruler is blank side facing out. The wooden side strips are cut and nailed and/or glued to the bottom of the base at each end. This strip is for added height and where the non-slip feet are mounted. The draw catch is in two pieces and are placed, one at the base of a side arm and screwed into place while the other piece is attached to the base using screws. When the side arms are in an upright position, the latch top connects to the latch bottom and secures the arms in place. The hook and staple is in two pieces. Each piece is attached to outside top of each arm. When arms are in collapsed position, the hook and staple connect together. The hook and staple are screwed into place. Three dowel rods are cut and sanded. On one end of dowel a hole is drilled, and a cotter pin is inserted. On the same end of each dowel a copper ring is attached to rod. The dowel holders are cut and the holes are cut and sanded. The dowel holders are glued and/or nailed to each end of top of front facing base overlapping the ruler and spacer on the front.

A method of using the present invention may include the following. Place a roll or spool of material on a dowel rod with the material rolling up and over front of spool. Guide the material down into the space between the base and the ruler, then pull out a over work table or cutting mat. The ruler is there as a guide and keep the material low and close to the cutting mat pulling and cutting as you go. The multiple dowels and levels provide ample space for working with multiple materials at once and allows simultaneous measuring and cutting. This can save a lot of time for the crafter as well as prevent frustration of working with materials that curl up while working with them. The non-slip feet are very helpful for keeping the unit secure while working. The unit collapses down by unhooking the side arms and laying them flat. The hook and staple secure the side arms in folded position if being stored vertically.

It should be understood, of course, that the foregoing relates to exemplary embodiments of the invention and that modifications may be made without departing from the spirit and scope of the invention as set forth in the following claims.

What is claimed is:

1. A collapsible stand for holding and dispensing rolls of craft materials comprising:

a planar base comprising a front, a rear, a first side, a second side, an upper surface, and a lower surface, wherein the base is configured to rest upon a support surface;

a first arm pivotably coupled to the upper surface at the first side by a first hinge, wherein at least one first dowel slot is defined through the first arm; and a second arm pivotably coupled to the upper surface at the second side by a second hinge, wherein at least one second dowel slot is defined through the second arm, wherein the collapsible stand comprises an expanded configuration and a collapsed configuration, wherein in the expanded configuration the first arm and the second arm are pivoted upward from the base in a vertical position that is generally perpendicular to the base so that the first dowel slot aligns with the second dowel slot and the first arm is spaced apart from the second arm, and in the collapsed configuration the first arm and the second arm are pivoted downward in a horizontal position that is parallel to the base with the first arm and the second arm resting on the base;

at least one dowel rod, wherein the at least one dowel rod extends between the first arm and the second arm and fits within the at least one first dowel slot and the at least one second dowel slot in the expanded configuration;

wherein the at least one dowel rod is configured to extend through the rolls of craft materials to store the rolls of craft materials thereon;

wherein a ruler is attached to the front of the base by spacers so that a gap is defined between the ruler and the front of the base with the ruler being generally parallel to the front of the base;

wherein, when in use, the craft materials are configured to be pulled away from the rolls and guided through the gap between the base and the ruler and slid underneath the ruler;

a first dowel rod holder block and a second dowel rod holder block being spaced apart and mounted to the base, wherein the first dowel rod holder block and the second dowel rod holder block each have at least one generally circular hole therein, wherein each hole of the first dowel rod holder block aligns with each hole of the second down rod holder block; wherein, in the collapsed configuration, a first dowel rod from said at least one dowel rod fits within a corresponding hole of the first dowel rod holder block and a corresponding hole of the second dowel rod holder block in a horizontal position parallel to the base.

2. The collapsible stand of claim 1, further comprising:

a first lock configured to releasably lock the first arm in the expanded configuration; and a second lock configured to releasably lock the second arm in the expanded configuration.

3. The collapsible stand of claim 1, further comprising a collapse lock configured to lock the first arm to the second arm in the collapsed configuration.

4. The collapsible stand of claim 1, wherein the at least one first dowel slot comprises a first top slot defined on an upper edge of the first arm, a first bottom slot, and a first middle slot defined in between the first top slot and the first bottom slot, wherein the at least one second dowel slot comprises a second top slot defined on an upper edge of the second arm, a second bottom slot, and a second middle slot defined in between the second top slot and the second bottom slot, wherein the first top slot and the second top slot align in the expanded configuration, the first bottom slot and the second bottom slot align in the expanded configuration, and the first middle slot and the second middle slot align in the expanded configuration.

5. The collapsible stand of claim 4, wherein the first middle slot and the first bottom slot are each defined starting from an outer edge of the first arm and angle downwards towards a longitudinal axis of the first arm, and the second middle slot and the second bottom slot are each defined starting from an outer edge of the second arm and angle downwards towards a longitudinal axis of the second arm.

6. The collapsible stand of claim 1, further comprising at least one dowel lock configured to releasably retain the at least one dowel rod within the at least one first dowel slot and the at least one second dowel slot.

7. The collapsible stand of claim 1, further comprising a plurality of feet coupled to the lower surface of the base.

* * * * *